United States Patent [19]

Oswald

[11] 4,025,743

[45] May 24, 1977

[54] THREE POSITION FLASHLIGHT SWITCH

[75] Inventor: Anton H. Oswald, Wayne, N.J.

[73] Assignee: Bright Star Industries, Inc., Clifton, N.J.

[22] Filed: Sept. 5, 1975

[21] Appl. No.: 610,550

[52] U.S. Cl. ..... 200/60; 200/16 R; 200/18; 200/153 L; 200/153 LA; 200/295

[51] Int. Cl.[2] ..... H01H 15/02; H01H 9/02; F21V 23/04

[58] Field of Search ..... 200/6 B, 6 BA, 6 BB, 200/6 C, 16 R, 16 C, 16 D, 18, 4, 60, 153 L, 153 LA, 153 LB, 159 A, 246, 250, 283, 293–296, 329, 330, 339, 340; 240/10.63, 10.66

[56] References Cited

UNITED STATES PATENTS

| | | | |
|---|---|---|---|
| 1,853,358 | 4/1932 | Hubbell, Jr. | 200/60 X |
| 2,908,827 | 10/1959 | Hickman | 200/16 D UX |
| 3,221,115 | 11/1965 | Feher, Jr. | 200/16 R |
| 3,243,528 | 3/1966 | Brady | 200/153 L X |
| 3,249,725 | 5/1966 | Hutt et al. | 200/153 LA |
| 3,525,828 | 8/1970 | Eckhart et al. | 200/16 D |
| 3,592,983 | 7/1971 | Kroll et al. | 200/16 D |
| 3,851,126 | 11/1974 | Keller | 200/60 |
| 3,917,921 | 11/1975 | Jakubauskas | 200/16 R |

FOREIGN PATENTS OR APPLICATIONS

| | | | |
|---|---|---|---|
| 1,093,644 | 12/1967 | United Kingdom | 200/60 |

*Primary Examiner*—James R. Scott
*Attorney, Agent, or Firm*—James & Franklin

[57] ABSTRACT

The switch includes a slide, mounted for movement along the housing between first, second and third positions, and carrying a depressable pushbutton. A flexible contact is movable by the pushbutton to a position wherein it is operatively connected to a fixed contact to complete the electrical circuit. The pushbutton and the flexible contact each have corresponding camming and non-camming surfaces thereon which respectively interact to move the flexible contact towards the fixed contact. The corresponding camming surfaces interact only as the slide is moved from the second to the third position. The corresponding non-camming surfaces interact only when aligned and the pushbutton is depressed. Since none of the surfaces operatively interact as the slide is moved from the first toward the second position, wearing of the interacting surfaces is substantially reduced.

26 Claims, 5 Drawing Figures

THREE POSITION FLASHLIGHT SWITCH

The present invention relates to electrical switches and in particular to a three-position flashlight switch.

Flashlights and other similar portable battery-operated light sources are commonly equipped with three-position switches. Such switches normally include an actuating member with a pushbutton mounted thereon. The actuating member can be moved from a first position wherein the switch contacts are disengaged preventing completion of an electrical circuit, even when the pushbuttom is depressed, to a second position wherein the contacts are conditionally engagable by the depression of the pushbutton member, and a third position where the contacts are engaged to complete the circuit.

Conventional three-position switches of this type consist of a relatively large number (in some cases as much as sixteen) of separate metallic parts, including rivets, strip and contacts, thereby making them relatively expensive to manufacture and assemble. In addition, such switches normally cannot be disassembled without destroying the switch if repair is required. Thus, if the parts wear out, the entire switch assembly must be replaced. As a practical matter, this substantially reduces the operational life of such switches and the flashlights on which they are utilized.

It is, therefore, a prime object of the present invention to provide a three-position flashlight switch having no sliding metal parts.

It is another object of the present invention to provide a three-position flashlight switch which can be disassembled without destroying the switch such that worn parts therein may be replaced.

It is a further object of the present invention to provide a three-position flashlight switch consisting of a relatively small number of separate parts which can be inexpensively manufactured and assembled.

Yet another object of the present invention is to provide a three-position flashlight switch wherein its parts cooperate in a more reliable and functionally effective manner than heretofore.

In accordance with the present invention, the switch comprises a housing and an actuating member movably mounted on the housing for movement relative thereto in a first direction between first, second and third positions and in a second direction between normal and depressed positions. First and second contacts are mounted on the housing. The second contact is movable between a first position wherein the contacts are spaced from each other and a second position wherein the contacts are operatively connected. The actuating member and the second contact each have a first surface extending in the first direction and a second surface generally inclined with respect to the first surface in a direction away from the second contact. The corresponding surfaces are out of alignment when the number is in the first position such that a movement of the number to its depressed position is ineffective to cause movement of the second contact to its second position. The corresponding surfaces are aligned when the actuating member is in the second position to cause movement of the second contact to its second position when the member is in the depressed position. The corresponding second surfaces on the second contact and actuating member coact, as the member is moved from the second to the third position, to move the second contact to its second position, the first surface of the actuating member being effective to retain the second contact in its second position when the member is in the third position.

The second contact is formed of resilient material and mounted at one end thereof to the housing in cantilever fashion. The flexibility of this contact serves to urge the actuating member in the second direction towards its normal position when the member is in the second position. The actuating member comprises a slide slidably mounted in the housing and a pushbutton mounted on the slide portion for movement therewith in said first direction and movement relative thereto in the second direction. The first and second directions are substantially parallel to each other.

The housing is provided with a recess with an overhanging edge forming a groove and the actuating member has a wall with a flange which is insertable into the groove to form a sliding connection therewith. The walls of the actuating member are made of flexible material such that the walls may be moved inwardly so as to remove the actuating member from the housing thereby making replacement of the parts of the switch possible.

To the accomplishment of the above and to such other objects as may hereinafter appear, the present invention relates to a three-position flashlight switch as set forth in the annexed claims and described in the specification taken together with the drawings wherein like numerals refer to like parts and in which:

Figure 1:
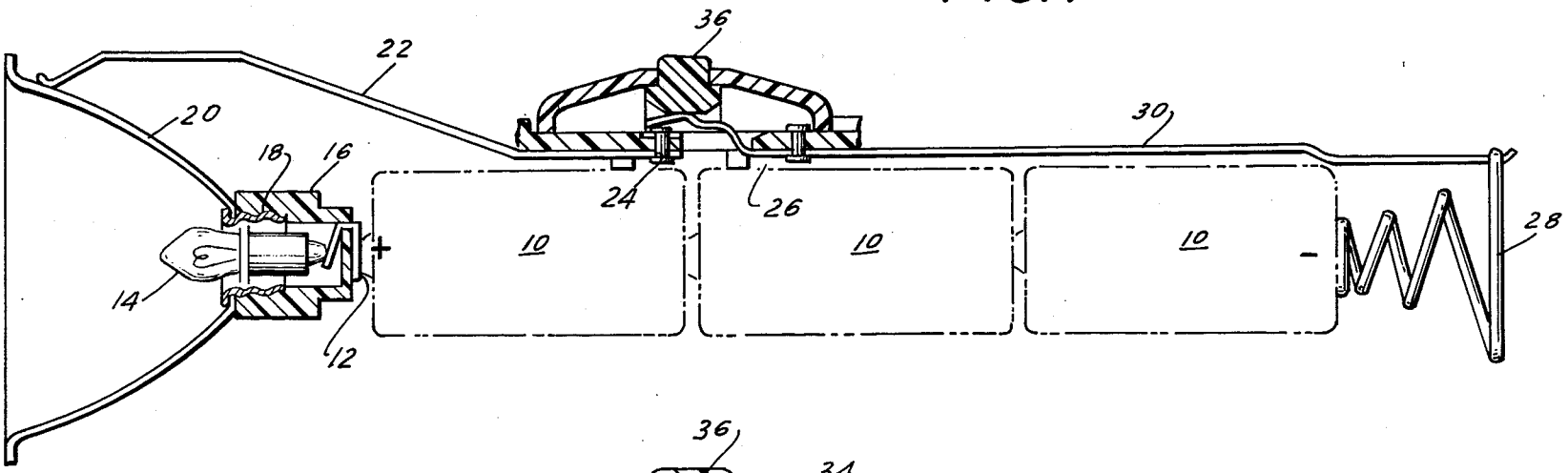
FIG. 1 is a semischematic diagram of a flashlight electrical circuit with the switch of the present invention included therein.

As shown in FIG. 1, a flashlight electrical circuit comprises two or more (three are shown) batteries 10 which are arranged in series such that the positive pole of one battery is adjacent the negative pole of the next battery in series. The positive pole of the first battery 10 is in contact with a metallic contact element 12 which is also connected to one terminal of a bulb 14. Bulb 14 and element 12 are mounted within a non-conducting socket member 16 which has a conducting interior surface 18 adjacent the side of the bulb which forms the other contact thereof.

Conductive surface 18 is in communication with a substantially conically shaped reflector 20 which is made of conductive material. A conductive element 22 electrically connects reflector 20 with contact 24 of the switch of the present invention. The other contact 26, preferably made of flexible conductive material is connected to a spring-like member 28 by an elongated conductive element 30. Spring-like member 28 is operatively connected to the negative pole of the last battery 10 in series and, in addition, exerts a force thereon thereby assuring the appropriate electrical contact between the poles on each of the batteries and the batteries and element 12.

When contact 26 is in communication with contact 24, an electrical circuit is completed such that bulb 14 is energized. As described in detail below, the switch of the present invention has three position — an "off"

position and an intermediate position wherein when a pushbutton mounted on the switch is depressed, the circuit is completed.

The switch of the present invention comprises a housing, generally designated 32, in which contacts 24 and 26 are situated. Housing 32 forms a portion of the body of the flashlight. A slide member 34, preferably made of a flexible plastic material, has an upper surface having separated inclined knurled or grooved sections which may be slightly arcuate to facilitate movement of the slide with respect to the housing by the user's finger.

Between the knurled sections of slide member 34 is an aperature through which a portion of a pushbutton member 36 extends. This permits the user to depress the pushbutton and thereby move it in a direction perpendicular to the surface of the flashlight body. That portion of pushbutton 36 situated in the interior of slide member 34 is larger than the aperture in slide 34 so as to prevent pushbutton 36 from passing through the aperture.

The central portion of the undersurface of pushbutton 36 has a first surface 38 substantially parallel to the flashlight body and a second surface 40 which is inclined with respect thereto. A pair of runners 42 are provided, and extending downwardly on each side of surface 40. Runners 42 are spaced from each other a distance greater than the width of contact 26 such that contact 26 may extend within the recess defined between runners 42 and surface 40. Extending inwardly towards each side of pushbutton 36 from the interior sides of member 34 is a switch lock tab 44 having a rounded bottom surface 46. Switch lock tabs 44 move with slide 34 as the slide moves with respect to housing 32. Housing 32 has three pairs of locking grooves **48*a*, 48*b*, and 48*c* therein, one groove from each pair being situated on a different side of pushbutton 36 in spaced relationship along the upper surface of the flashlight body underneath the path of travel of the actuating member 34. Each pair of these grooves 48*a*, 48*b*, 48*c* corresponds to one of the positions of slide 34. In each of the positions of slide 34, the rounded portion 46 of the switch lock tabs 44 are aligned with one pair of the locking grooves 48*a*, 48*b*, 48*c* and thus are seated therein. The cooperation of rounded portions 46 and grooves 48 tends to retain slide 34** in the selected position in detent fashion.

Figure 5:
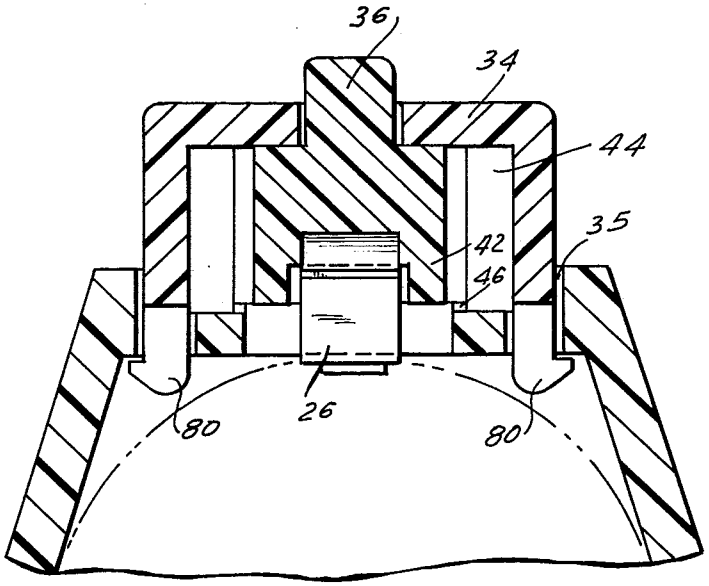
FIG. 5 is a view taken along line 5—5 of FIG. 2.

As best seen in FIG. 5, the walls of slide 34 extend into a pocket or recess 35 in the flashlight body. The tip of the walls of slide 34 are provided with a flange 50 which is insertable below the overhanging edge of the flashlight body to provide a sliding connection between slide 34 and the flashlight body. In addition, the bottom edge of the walls of slide 34 are rounded to form a camming surface. The flexibility of the walls of slide 34 and the camming surface on the edge thereof permits the snap insertion into the flashlight body of the slide 34 and thus the switch assembly. Moving the walls 34 towards each other, as by squeezing the sides of slide portion 34, permits flanges 50 to clear the inner surface of the flashlight body such that the slide 34 may be removed therefrom.

Contact 26 is connected to the flashlight body in a cantilever fashion and has a step-like configuration with a surface 52 which is substantially parallel to surface 38 on the underside of pushbutton 36 and which extends in a direction parallel to the movement of the slide with respect to the flashlight body. In addition, contact 26 has a surface 54, adjacent surface 52, which is inclined with respect to surface 52 and substantially parallel to surface 40 on the underside of pushbutton 36.

Figure 2:
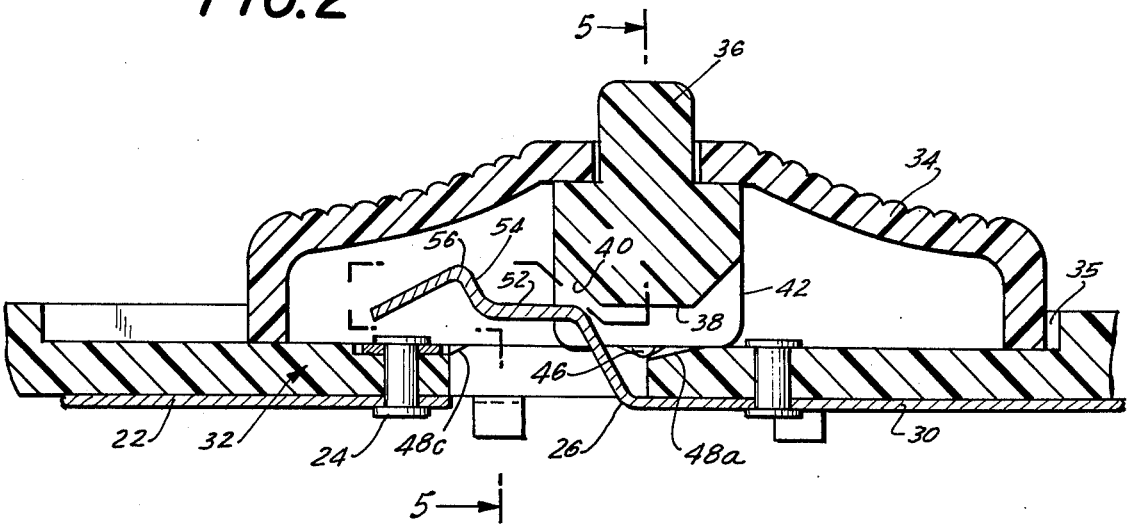
FIG. 2 is a side cross-sectional view of the switch of the present invention in the "off" position.

FIG. 2 shows the switch of the present invention in the "off" position. In this position, surfaces 38 and 40, on the underside of pushbutton 36, are out of registration with the corresponding surfaces 52 and 54, respectively of contact 26. In this position, the pushbutton cannot exert a downward force on contact 26 and contacts 24 and 26 are spaced from each other causing the electrical circuit to be open. Pushbutton 36 cannot be depressed because runners 42 are at least partially resting on the upper surface of housing 32. In this position, the rounded portion 46 of each switch lock tab 44 is situated within locking grooves **48*a***.

Figure 3:
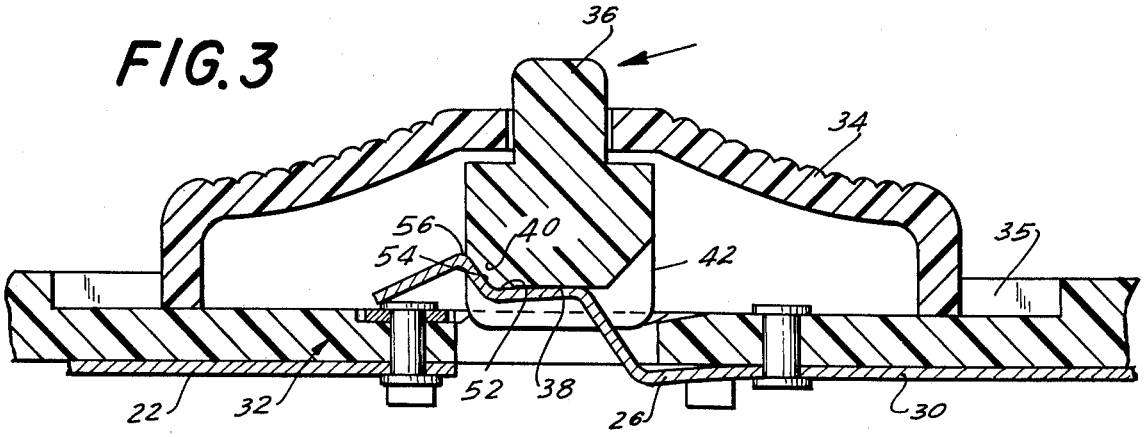
FIG. 3 is a view similar to FIG. 2 showing the switch of the present invention in the intermediate position.

When slide 34 is moved to its intermediate or second position, surfaces 38 and 40 on the underside of pushbutton 36 register with the corresponding surfaces 52 and 54, respectively, on contact 26. Surface 52 of contact 26 is situated between runners 42 of pushbutton 36. Runners 42 are aligned with an opening in housing 32 which permits depression of pushbutton 36. In this position, when pushbutton 36 is depressed, as shown in FIG. 3, surface 38 on the underside of pushbutton 36 engages surface 52 of contact 26 and pushes same towards the flashlight body such that the contact flexes and the edge thereof engages contact 24 to complete the electrical circuit. When pushbutton 36 is released, the flexibility of contact 26 moves the pushbutton to its normal or undepressed position and the electrical contact is broken. Thus, in the second or intermediate position, electrical contact is conditionally achieved by the depression of pushbutton 36. In this position, the rounded undersurface 46 of each switch lock tabs 44 is within locking grooves **48*b***.

Figure 4:
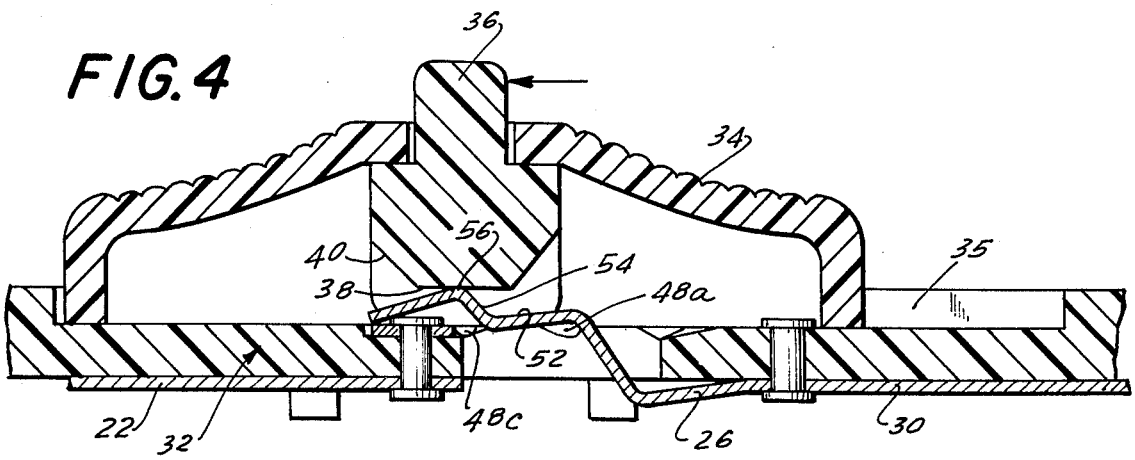
FIG. 4 is a view similar to FIG. 2 showing the switch of the present invention in the "on" position.

As slide 34 is moved from the second to the third position, surface 40 on the underside of pushbutton 36 coacts with surface 54 on contact 26 to cam the contact in a counterclockwise direction (as seen in the figures) such that the bend 56 therein which forms the upper portion of surface 54 is aligned with surface 38 on the underside of pushbutton 36. This causes contact 26 to engage contact 24 thereby completing the electrical circuit. The relative rigidity of the portion of contact 26 in contact with surface 38 prevents any substantial depression of pushbutton 36. In this position, contact 36 remains in engagement with contact 24 and no depression of the pushbutton is required in order to complete the circuit. The third or "on" position of slide 34 is shown in FIG. 4. It should be noted that the rounded undersurface 45 of each of the switch lock tabs 44 are seated within groove **48*c* in the third or "on" position of slide 34**.

It should be appreciated that the switch of the present invention has no sliding metal parts. The switch consists of seven separate parts, five of which are metal. The only parts which can wear out are the switch slide 26 and the pushbutton 36, both of which are preferably made of plastic. While it will take a relatively long time for this to occur, should these parts wear to the point where the switch no longer functions properly, these parts can be easily replaced by pushing the walls of slide portion 36 inwardly to disengage flanges 50 from the grooves in the flashlight body and removing the slide portion 34. The parts can thus be replaced and slide portion 34 snapped back into engagement with the flashlight body.

Thus, the present invention is comprised of relatively few parts which are inexpensive to manufacture and assemble. In addition, the switch has no sliding metal parts and any of the parts thereof can be easily replaced if necessary.

While only a single preferred embodiment of the present invention has been disclosed herein for purposes of illustration, it is obvious that many variations and modifications can be made thereto. It is intended to cover all of these variations and modifications which fall within the scope of the present invention as defined by the annexed claims.

What is claimed is:

1. A switch comprising a housing, a slide mounted on said housing for movement relative thereto in a first direction between first, second and third positions and a pushbutton mounted on said slide for movement with said slide in said first direction and movement relative to said slide in said second direction between normal and depressed positions, first and second contacts mounted on said housing, said second contact being movable between a first position wherein said contacts are operatively connected, said pushbutton and said second contact each having a first surface and a second surface generally inclined with respect to said first surface in a direction away from said second contact, said corresponding surfaces being out of alignment when said slide is in said first position whereby movement of said pushbutton toward its depressed position is ineffective to cause movement of said contact to its second position and said corresponding surfaces being aligned when said slide is in said second position to cause movement of said second contact to its second position when said pushbutton is in said depressed position, and second surfaces coacting, as said slide is moved from said second to said third position, to move said contact to its second position and said first surface to said pushbutton being effective to retain said second contact in its second position when said slide is in said third position.

2. The switch of claim 1 wherein said housing has a recess with an overhanging edge forming a groove and said slide has a wall with a flange, said flange being insertable into said groove to form a moving connection therebetween.

3. The switch of claim 2 wherein said wall is flexible and wherein said flange can be removed from said groove by the inward flexing of said wall.

4. The switch of claim 1 wherein said slide has a recess, within which said pushbutton is movably mounted.

5. A switch comprising a housing, an actuating member mounted on said housing for movement relative thereto in a first direction between first, second and third positions and having a portion thereof movable relative to said housing in a second position, between normal and depressed positions, first and second contacts, said second contact being movable between a first position wherein said contacts are spaced from each other and a second position wherein said contacts are operatively connected, said portion and second contact each having corresponding camming and non-camming surfaces which are effective, when respectively aligned, to move said second contact towards said second position, said corresponding camming surfaces operatively interacting only as said member is moved between said second and third positions and said corresponding non-camming surfaces operatively interacting only as said portion is moved towards said depressed position.

6. The switch of claim 5 further comprising means for preventing the movement of said portion towards said depressed position when said member is in said first position.

7. The switch of claim 5 further comprising means for preventing the movement of said portion towards said depressed position when said member is in said third position.

8. The switch of claim 5 wherein said contact urges said member towards said normal position when said member is in said second position.

9. The switch of claim 5 wherein said second contact is resilient and mounted to said housing at one end thereof.

10. The switch of claim 5 wherein said respective inclined surfaces are substantially parallel.

11. The switch of claim 5 wherein said first and said second directions are substantially perpendicular to one another.

12. The switch of claim 5 wherein said first and second surfaces on said second contact form a step-like configuration.

13. The switch of claim 5 wherein said member comprises a slide slidably mounted on said housing and having an opening therein, said portion comprising a pushbutton at least partially mounted within said opening on said slide for movement with said slide in said first direction and movement within said opening relative to said slide in said second direction.

14. The switch of claim 13 wherein said housing has a recess with an overhanging edge forming a groove and said slide has a wall with a flange, said flange being insertable into said groove to form a moving connection therebetween.

15. The switch of claim 14 wherein said wall is flexible and wherein said flange can be removed from said groove by the inward flexing of said wall.

16. The switch of claim 5 further comprising means for removably mounting said actuating member to said housing.

17. The switch of claim 16 wherein said mounting means comprises flexible walls on said actuating member, said walls being insertable into a recess in said housing in a snap fit relationship.

18. A switch assembly comprising a support, a first contact mounted on said support, a second and flexible contact mounted on said support and having a part normally spaced from said first contact but movable into engagement therewith to close an electrical circuit between them, and an actuating mechanism for said switch comprising a carrier mounted on said support for movement adjacent said second contact between first, second and third positions, a manually actuatable element carried by said carrier, movable therewith and movable relative thereto operatively relatively toward and away from said second contact, said carrier when in said first position locating said element such that when it is positioned toward said second contact it fails to move said second contact into engagement with said first contact said carrier when in said second position locating said element such that when it is positioned toward said second contact it is in engagement with said second contact and moves the latter into engagement with said first contact but when it is positioned away from said second contact it fails to move said second contact into engagement with said first contact and said carrier when it is in said third position locating said element such that when it is positioned away from said contact it is in engagement with said second contact and moves the latter into engagement with said first contact.

19. The switch of claim 18 in which said second contact is movable in a given direction into engagement with said first contact, said carrier is movable relative to said support in a direction substantially perpendicular to said given direction and wherein said element is movable relative to said carrier substantially in said given direction.

20. The switch assembly of claim 19 in which said second contact extends substantially in said given direction toward said first contact.

21. The switch assembly of claim 20 in which said element at least in its second and third positions is located on the other side of said second contact from said first contact.

22. The switch assembly of claim 19 in which said element at least in its second and third positions is located on the other side of said second contact from said first contact.

23. The switch assembly of claim 18 in which said element at least in its second and third positions is located on the other side of said second contact from said first contact.

24. The switch assembly of claim 23 in which said second contact comprises lower and upper engagable parts and said element comprises an engaging part which, with said element in its position relatively remote from said second contact, is at a level above said lower engagable part and below said upper engagable part, said carrier, when in said second position, locating said element above and in registration with said lower engagable part and when in said third position locating said element above and in registration with said upper engagable part.

25. The switch assembly of claim 24 in which at least one of the facing edges of said engaging part and said upper engagable part define an inclined cam.

26. A switch comprising a housing, an actuating member mounted on said housing for movement relative thereto in a first direction between first, second and third positions and having a portion movable relative to the remainder of said member in a second direction between normal and depressed positions, means on said housing for preventing movement of said portion towards said depressed position when said member is in said first and said third positions, first and second contacts mounted on said housing, said second contact being movable between a first position and wherein said contacts are spaced from each other and a second position wherein said contacts are operatively connected, said portion of said member and said contact each having a first surface extending in said first direction and a second surface, generally inclined with respect to said first surface, said corresponding surfaces being out of alignment when said member is in said first position, said corresponding surfaces being aligned when said member is in said second position to cause movement of said second contact to its second position when said portion of said member is in said depressed position, said second surfaces coacting, as said member is moved from said second to said third position to move said contact to its second position and said first surface of said portion of said member being effective to retain said second contact in its second position when said member is in said third position.

* * * * *